US008209923B1

(12) United States Patent
Rich

(10) Patent No.: US 8,209,923 B1
(45) Date of Patent: Jul. 3, 2012

(54) VENT HOOD AND FLASHING ASSEMBLY FOR METAL ROOF

(76) Inventor: Daniel L. Rich, Rochester, WA (US)

( * ) Notice: Subject to any disclaimer, the term of this patent is extended or adjusted under 35 U.S.C. 154(b) by 246 days.

(21) Appl. No.: 12/799,660

(22) Filed: Apr. 28, 2010

(51) Int. Cl.

| | |
|---|---|
| ***E04H 12/28*** | (2006.01) |
| ***E04D 13/00*** | (2006.01) |
| ***F23J 13/08*** | (2006.01) |
| ***F23L 17/02*** | (2006.01) |
| ***F24F 13/08*** | (2006.01) |
| ***F24F 7/02*** | (2006.01) |
| ***F24F 13/20*** | (2006.01) |

(52) U.S. Cl. ..... 52/219; 52/101; 285/42; 454/4; 454/7; 454/35; 454/348; 454/362; 454/364; 454/365; 454/366; 454/367; 454/368

(58) Field of Classification Search ..... 52/219, 52/198, 199, 302.1, 101; 285/42; 454/4, 454/7, 35, 348, 362, 365–368
See application file for complete search history.

(56) References Cited

U.S. PATENT DOCUMENTS

| | | | | |
|---|---|---|---|---|
| 1,686,881 | A * | 10/1928 | Stephenson | 285/43 |
| 2,825,276 | A * | 3/1958 | Porter | 454/367 |
| 3,398,671 | A * | 8/1968 | Acosta | 454/36 |
| 3,886,852 | A * | 6/1975 | Acosta | 454/47 |
| 4,333,660 | A * | 6/1982 | Cupit | 277/630 |
| 4,437,687 | A * | 3/1984 | Wilson | 285/42 |
| 4,664,390 | A * | 5/1987 | Houseman | 277/606 |
| 5,176,408 | A * | 1/1993 | Pedersen | 285/42 |
| 5,226,263 | A | 7/1993 | Merrin et al. | |
| 5,402,611 | A * | 4/1995 | Vagedes | 52/198 |
| 6,954,947 | B1 | 10/2005 | Williams, Jr. | |
| 7,114,301 | B2 | 10/2006 | Bibaud et al. | |
| 2003/0054754 | A1 | 3/2003 | McKee | |
| 2003/0104779 | A1 | 6/2003 | Marts et al. | |
| 2004/0255523 | A1 * | 12/2004 | Bibaud et al. | 52/58 |
| 2005/0055889 | A1 | 3/2005 | Thaler | |

OTHER PUBLICATIONS

PortalsPlus 4YN30 Flat Roof Flashing advertisement, displayed on Internet at http://www.amazon.com/dp/B000LDIAEO/ref=asc_df_ et cetera.

Advertisement for flashing displayed on Internet at http://www.westcoastwashersusaa.com/flasherspecs.htm.

* cited by examiner

*Primary Examiner* — Robert Canfield
*Assistant Examiner* — Keith Minter
(74) *Attorney, Agent, or Firm* — Brian J. Coyne

(57) ABSTRACT

A vent hood and flashing assembly for use on a metal roof. A vent hood overlies and is joined to flashing. A cover and a screen overlie an upper end portion of the flashing to exclude rain, snow and pests. The flashing includes a resilient, flexible, water-repellant, flexible flange that extends outward from, and is attached to, a lower end portion of the flashing and a flexible, ring seal that overlies an upper surface of the flange. The assembly can be placed over a projection through an opening in a metal roof such that the cover and screen overlie an upper end of the projection and with the flashing surrounding the projection, and the flange can be bent to sealingly conform to the roof surface and secured thereto by fasteners.

11 Claims, 15 Drawing Sheets

VENT HOOD AND FLASHING ASSEMBLY FOR METAL ROOF

BACKGROUND OF THE INVENTION

1. Field of the Invention

This invention relates generally to flashing used in buildings to provide a seal between a surface and a member projecting therefrom; and more specifically, this invention relates to flashing applied to seal an opening in a roof surface and to a vent that projects through an opening in said surface. Still more specifically, this invention relates to apparatus that combines a vent hood for covering a vent pipe that projects through an opening in a metal roof surface with flashing that seals said metal roof surface opening.

2. General Background

Various kinds of vents commonly project up through openings in the roof of a building to release indoor steam and/or other gases to the atmosphere; these include plumbing vents such as bathroom and laundry room exhaust vents, and kitchen range vents. Such vents may include a cover or hood and a screen to prevent rain, insects and other pests from entering into the vent; see, for instance, the vent hood depicted in FIGS. 1, 2, the use of which is limited, however, to composition roofs. To install such a vent hood, lead and soft malleable metals in sheet form have been used as a flashing material because of the ease of deforming the material to follow the irregular contours usually presented by the surface of the roofing material. If, however, one attempts to use a vent hood of the kind depicted in FIGS. 1, 2, on a metal roof, it will tend to leak because it does not conform to the irregular surface of a metal roof. Nevertheless, prior to my invention, such a vent hood has been used even on metal roofs for lack of a better alternative, but doing so has required extensive, labor-intensive, cutting and fitting of flashing in order to create as adequate a seal as the circumstances would permit.

SUMMARY OF THE INVENTION

In order to provide a vent hood for use on a metal roof and an adequate seal therefor, my invention provides a vent hood and flashing assembly for use on an upper surface of a metal roof having an elongate projection extending upward therefrom. This assembly eliminates the previous need for extensive cutting and fitting of flashing to install a vent hood on a metal roof. The flashing includes a resilient, flexible, water-repellant sleeve that is sized to fit over, and surround, the projection. The flashing further includes a flange that extends outward from, and is attached to, a lower end portion of the flashing, which flange has an upper surface and a lower surface. A flexible, ring seal overlies the upper surface of the flange. The assembly further includes a vent hood that overlies and is joined to an upper end portion of the flashing; a cover member; a skirt that depends from the cover member; means for attaching the upper end portion of the flashing to the vent hood; and a screen that overlies the upper end portion of the flashing. The screen is dimensioned to exclude insects, rodents and other pests from entering the flashing. The skirt preferably comprises rubber, neoprene, polyurethane or similar elastomeric material.

In use, with the assembly placed over a projection through an opening in a metal roof such that the projection is surrounded by the flashing, the cover of the vent hood overlies an upper end of the projection, and the lower surface of the flange rests upon an upper surface of a metal roof, the flange is bent to conform to the surface of the roof and is attached thereto by fasteners.

BRIEF DESCRIPTION OF THE DRAWINGS

In the figures, shingles, vent pipe and corrugated metal roof are depicted in phantom outline as they form no part of the invention, and like numerals designate like component parts throughout the several views.

DESCRIPTION OF THE PREFERRED EMBODIMENT

Figure 1:
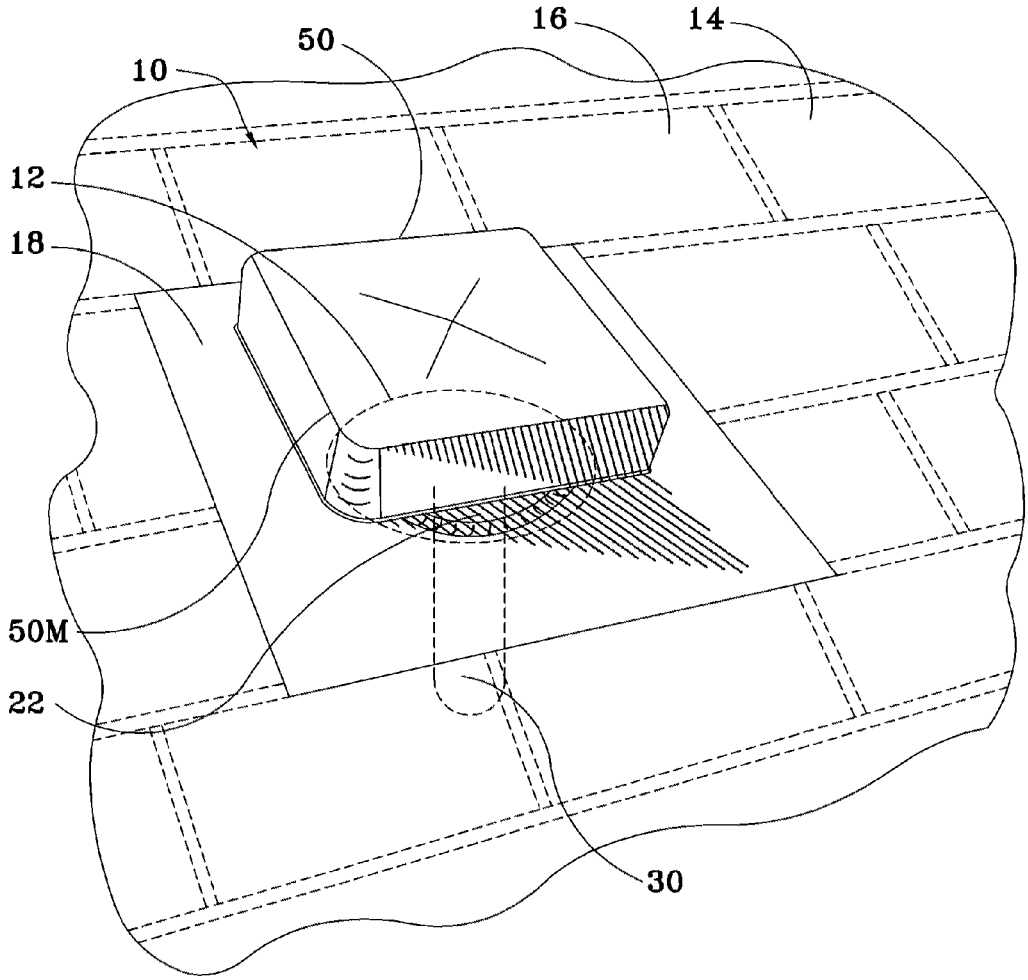
FIG. 1 (PRIOR ART)
FIG. 1 is a top, perspective, view of a fragmentary portion of a sloped roof that is covered with composition shingles, upon which is installed a vent hood of the prior art, and a vent pipe that projects vertically up through the roof into the vent hood.
Figure 2:
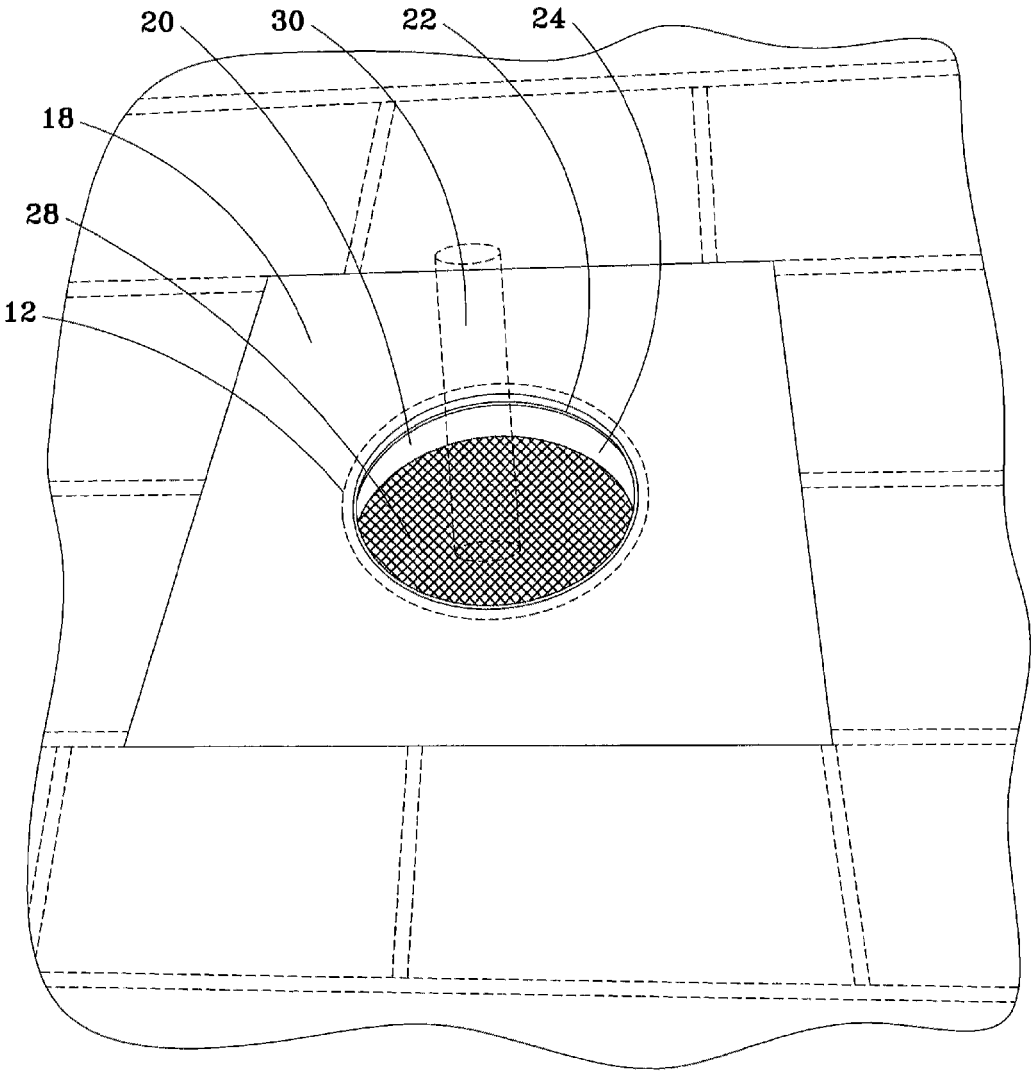
FIG. 2 (PRIOR ART)
FIG. 2 is a bottom, perspective view thereof.

Referring to FIGS. 1 and 2, a conventional vent hood 10 is depicted installed over an opening 12 in a sloped roof 14 that is covered with asphalt shingles 16 overlying roof sheathing (not shown). A vertical, elongate projection—namely, a vent pipe 30, depicted in phantom outline—projects upward through the roof opening 12 and into interior space of the vent hood 10. The vent hood 10 includes a generally planar, sheet metal base member 18 that rests atop shingles 16 that surround the roof opening 12. The base member 18 has a circular, central opening 20 that is disposed over the roof opening 12 and is coaxially aligned, more or less, with the vent pipe 30. An upstanding lip 22 is integral with the base member 18 and defines the circular opening 20 thereof. The vent hood 10 further includes an upstanding, cylindrical collar 24 that surrounds and tightly engages an outer surface of the lip 22. An annular flange 26 extends radially outward at a circular, upper margin of the collar 24. A mesh screen 28 is attached to the flange 26 and entirely covers the upper, circular opening defined by the collar 24. The vent hood 10 further includes a yoke 40, such as that depicted in FIG. 7, which yoke surrounds and engages an upper, outer surface of the collar 24. The yoke 40 comprises four metal strips 40*a*, 40*b*, 40*c*, and 40*d*, joined end-to-end, each strip bent through one-quarter sector of a circle to form an overall ring shape. Each strip 40*a*, 40*b*, 40*c*, 40*d* has a relatively long, first end 40*f* bent radially outward, which forms a mounting tab, and said tab has a free end portion that is bent circumferentially and apertured, and an opposite, relatively short, second end 40*s* that is bent radially outward and having a free end portion. The second ends 40*s* are joined to the first ends 40*f* by rivets (not shown), except for the first end 40*f* of strip 40*b* and the second end 40*s* of the strip 40*a*, which are attached by an adjustment screw 42 threaded through aligned apertures of said first and second ends. The vent hood 10 still further includes a cover member 50 comprising a flat, rectangular top having four side margins 50M. From the four side margins 50M depends a skirt 50S comprising parallel skirt panels 50*b* and 50*c* that attach by screws 54 inserted through apertures therein to the tabs 40*f* of strips 40*b* and 40*c*, respectively, and parallel skirt panels 50*a* and 50*d* that attach by screws 54 inserted through apertures therein to the tabs 40*f* of strips 40*a* and 40*d*, respectively. With the cover member 50 thus attached by the yoke 40 to the collar 24 by tightening adjustment screw 42, the cover member overlies the mesh screen 28 in vertically spaced relation, and the mesh screen overlies an upper end of the vent pipe 30. Accordingly, vent gases that rise through the vent pipe 30 can escape upward through collar 24 and through the mesh screen 28, and thence exit the vent hood 10 to the atmosphere through the space between the cover member 50 and the collar. The relatively flat upper surfaces of the asphalt shingles 16 permit a weather tight seal with the base member 18; accordingly, a vent hood 10 of this kind can be successfully installed over asphalt shingles 16 and other relatively flat roof surface coverings. Whenever it is desired to remove the cover member 50 from the vent hood 10 for access to the mesh screen 28, all that is necessary is to remove the four screws 54 and lift the cover member 50 up and away from the yoke 40.

Figure 3:
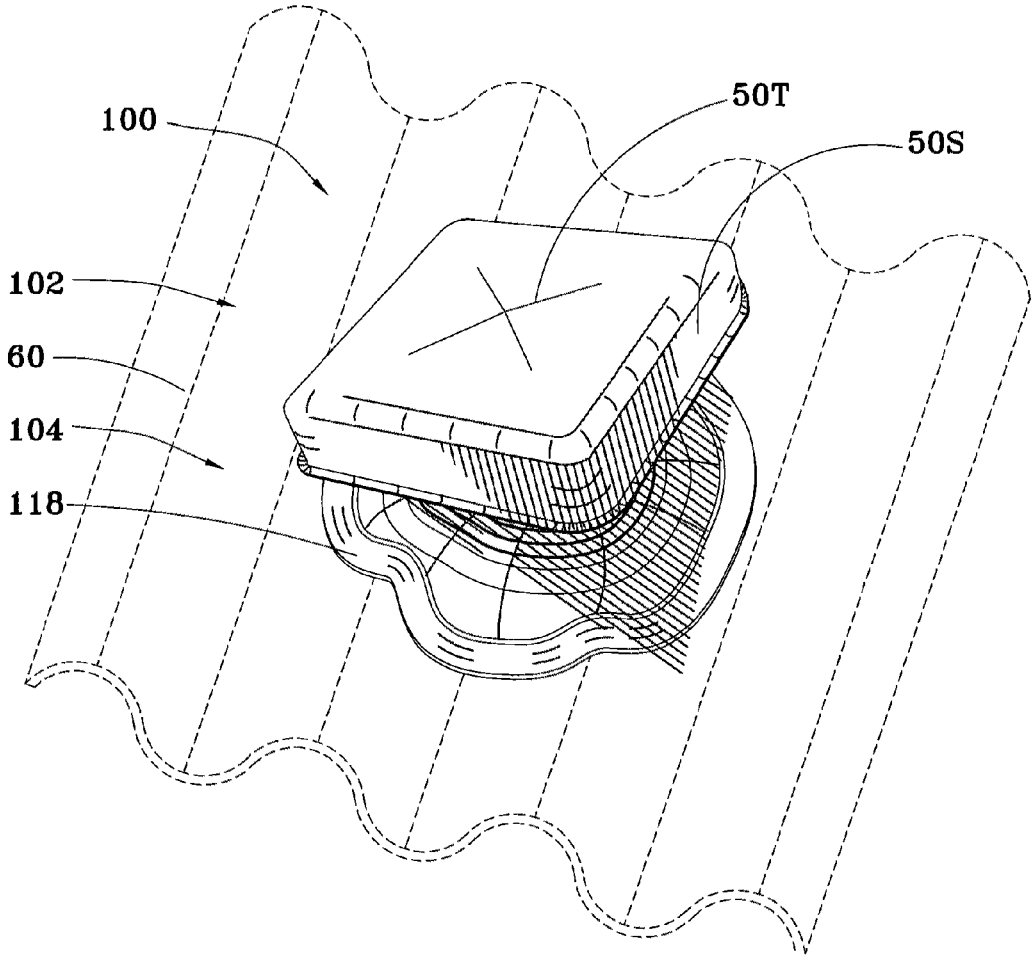
FIG. 3 is a top, perspective view of a fragmentary portion of a sloped roof that is covered with corrugated metal roofing, upon which is installed my vent hood and flashing assembly, and of a vent pipe that projects vertically up through the roof into my assembly.
Figure 4:
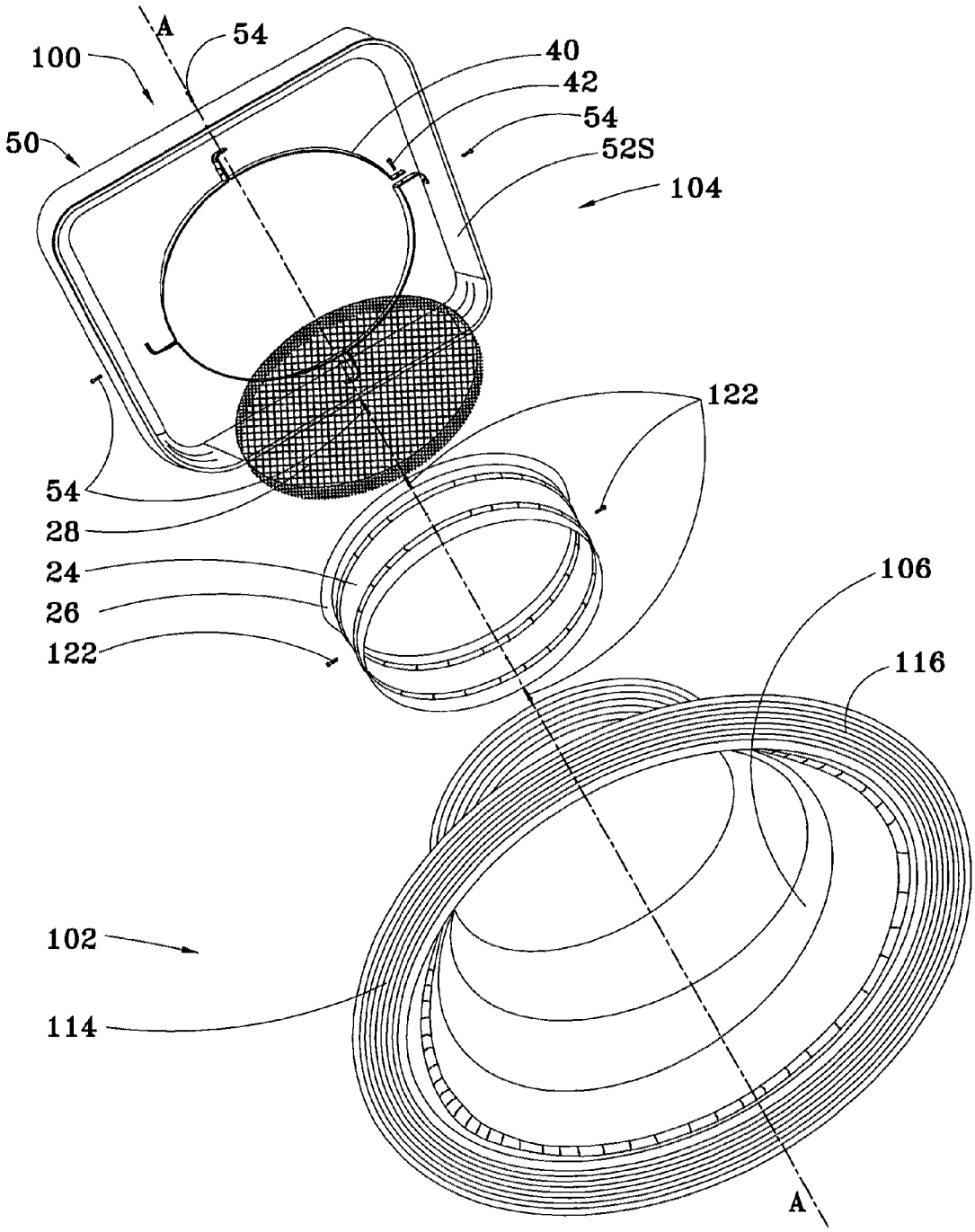
FIG. 4 is a bottom, perspective, exploded view of my assembly.
Figure 5:
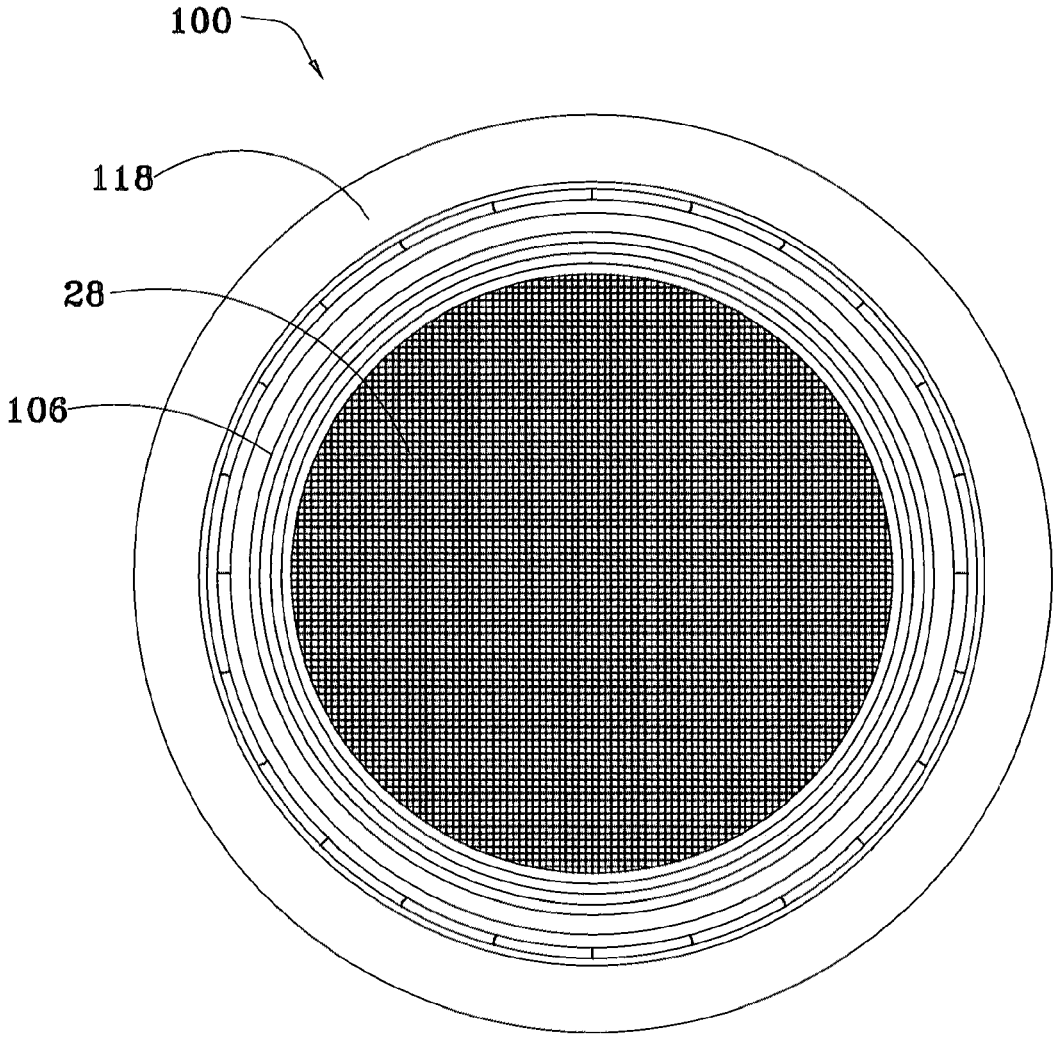
FIG. 5 is top, plan view of my assembly with its cover and yoke removed.

FIG. 3 depicts a corrugated metal roof 60 overlying and attached to roof sheathing (not shown). Although vent hoods 10 of the kind depicted in FIGS. 1 and 2 have been installed on such corrugated metal roofs, the results have been less than satisfactory as it has been difficult to adequately seal them against the weather. My vent hood and flashing assembly, denoted generally by the numeral 100 as depicted in FIG. 3 installed on a corrugated metal roof 60, overcomes this problem as it facilitates creating a long-lasting, permanent seal with a corrugated metal roof.

13. Referring now to FIGS. 3-7, it may be seen that my assembly includes the combination of a flashing, denoted generally by the numeral 102, with a vent hood, denoted generally by the numeral 104. In a first embodiment, the flashing 102 includes a flexible, resilient, water-repellant sleeve 106, having an overall shape of a truncated cone and a central opening 108, which sleeve is dimensioned to fit over, and surround, a vertical projection through a roof, such as a vent pipe 30. The sleeve 106 comprises a continuous array of concentric bands of elastomeric material 106B, such as rubber, neoprene, or polyurethane, the diameters of which bands gradually diminish from a maximum diameter at a bottom margin 110 to a minimum diameter at a top margin 112 of the sleeve, which bottom margin is, in fact, an outer margin of an annular flange portion 114 of the sleeve that extends radially outward from a lower end portion of the sleeve. A plurality of concentric, circular grooves 116 line a lower surface of the annular flange 114 for sealingly engaging a metal roof 60.

Matingly overlying and attached to an upper surface of the annular flange 114 is a flexible, annular, ring seal 118. The ring seal 118 preferably is fabricated from aluminum sheet that is sufficiently thin that the ring seal 118, as well as the underlying, annular flange portion 114 of the sleeve 102, can be bent to conform to the curved, upper surface of a corrugated metal roof 60.

The vent hood portion 104 of my assembly 100 is generally similar to the vent hood 10 depicted in FIGS. 1 and 2, but lacks the base member 18 thereof. The vent hood portion 104 includes an upstanding, cylindrical collar 24 that is dimensioned for close fitting insertion into, and engagement with, an upper, interior portion of the sleeve 106, whereby the upper portion of the sleeve is elastically expanded into a mating, cylindrical shape as well. The collar 24 is preferably fabricated from steel sheet. The upper end portion of the sleeve 106 and the collar 24 have each have four apertures (not shown) that are in register and spaced 90 degrees of arc apart about axis A-A, for receiving four screws 122 that secure the sleeve 106 to the collar 24. Exemplary dimensions for the collar 24 are, for instance, 7.5 inches inner diameter and height 3 inches, more or less. An annular flange 26 extends radially outward at a circular, upper margin of the collar 24, and a mesh screen 28 is attached to the flange 26 and entirely covers the upper, circular opening defined by the collar 24. A suitable radial width for the annular flange 26 is one-eighth to one-half inch. The mesh screen 28 is dimensioned to exclude rodents and other pests from entering the flashing 102.

Figure 7:
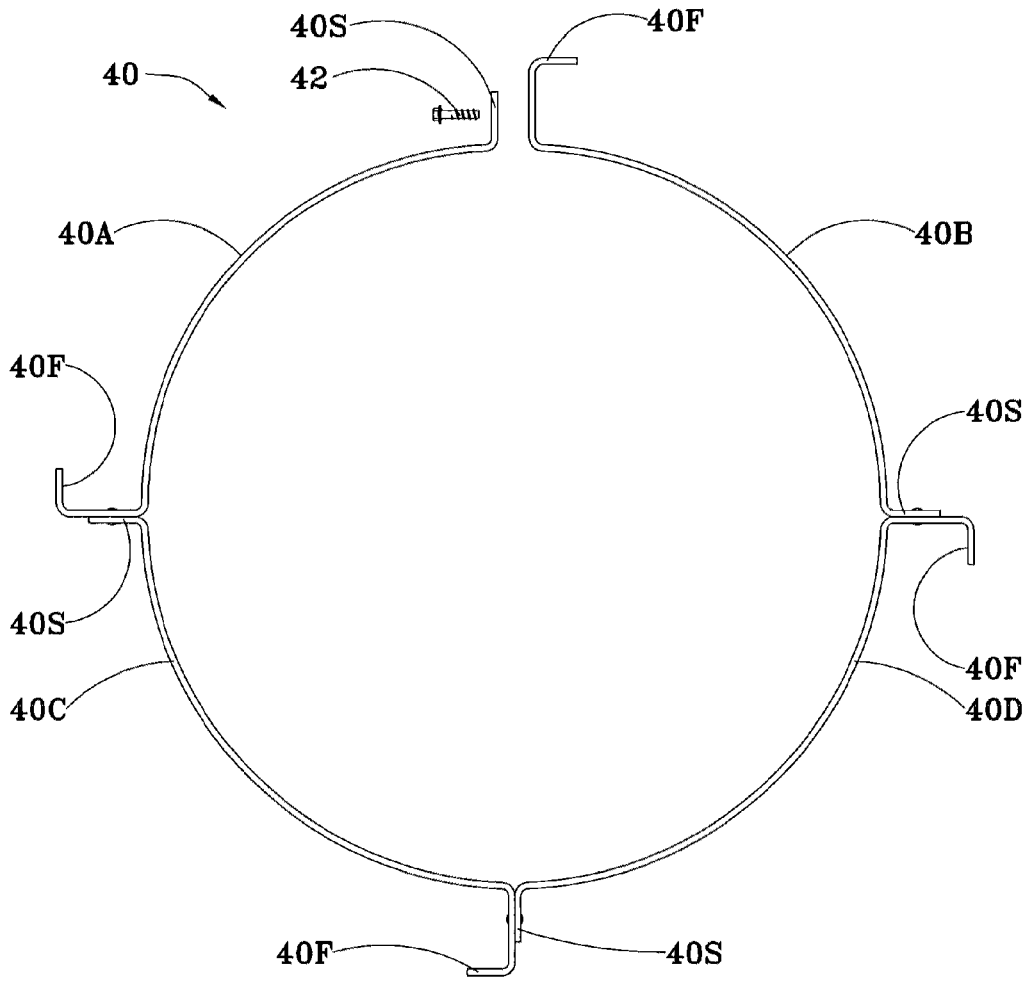
FIG. 7 is a top, plan view of the yoke of my assembly.

The vent hood 104 further includes a yoke 40, such as that depicted in FIG. 7, which yoke surrounds and engages an upper, outer surface of the upper, cylindrical portion 106U of the sleeve 106 and, consequently, surrounds the underlying collar 24 as well. The yoke 40 comprises four metal strips 40*a*, 40*b*, 40*c*, and 40*d*, joined end-to-end, each strip bent through one-quarter sector of a circle to form an overall ring shape. Each strip 40*a*, 40*b*, 40*c*, 40*d* has a relatively long, first end 40*f* bent radially outward, which forms a mounting tab, and said tab has a free end portion that is bent circumferentially and apertured, and an opposite, relatively short, second end 40*s* that is bent radially outward and having a free end portion. The second ends 40*s* are joined to the first ends 40*f* by rivets (not shown), except for the first end 40*f* of strip 40*b* and the second end 40*s* of the strip 40*a*, which are attached by an adjustment screw 42 threaded through aligned apertures of said first and second ends.

The vent hood 104 still further includes a cover member 50 comprising a flat, rectangular top having four side margins 50M. From the four side margins 50M depends a skirt 50S comprising parallel skirt panels 50*b* and 50*c* that attach by screws 54 inserted through apertures therein to the tabs 40*f* of strips 40*b* and 40*c*, respectively, and parallel skirt panels 50*a* and 50*d* that attach by screws 54 inserted through apertures therein to the tabs 40*f* of strips 40*a* and 40*d*, respectively. With the cover member 50 thus attached by the yoke 40 to the collar 24 by tightening adjustment screw 42, the cover member overlies the mesh screen 28 in vertically spaced relation, and the mesh screen overlies an upper end of the vent pipe 30. Accordingly, vent gases that rise through the vent pipe 30 can escape upward through collar 24 and through the mesh screen 28, and thence exit the vent hood 10 to the atmosphere through the space between the cover member 50 and the collar.

Figure 6:
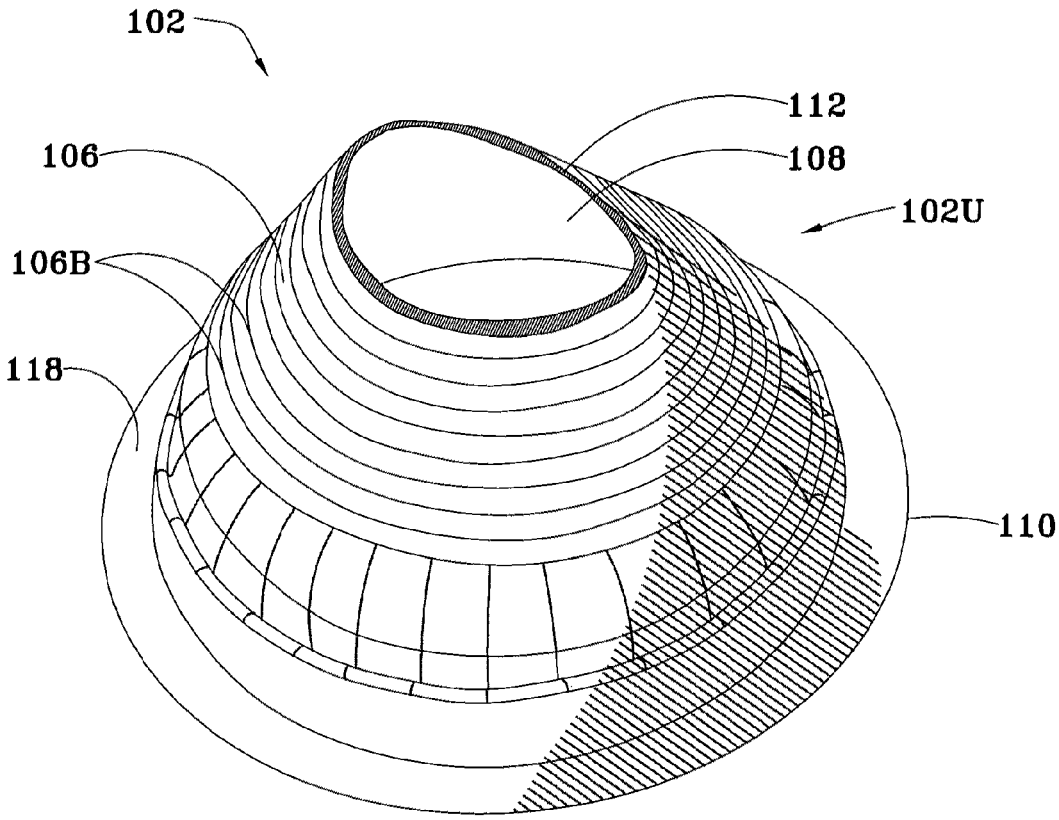
FIG. 6 is a top, perspective view of my assembly with the cover, yoke, collar, and screen removed.
Figure 8:
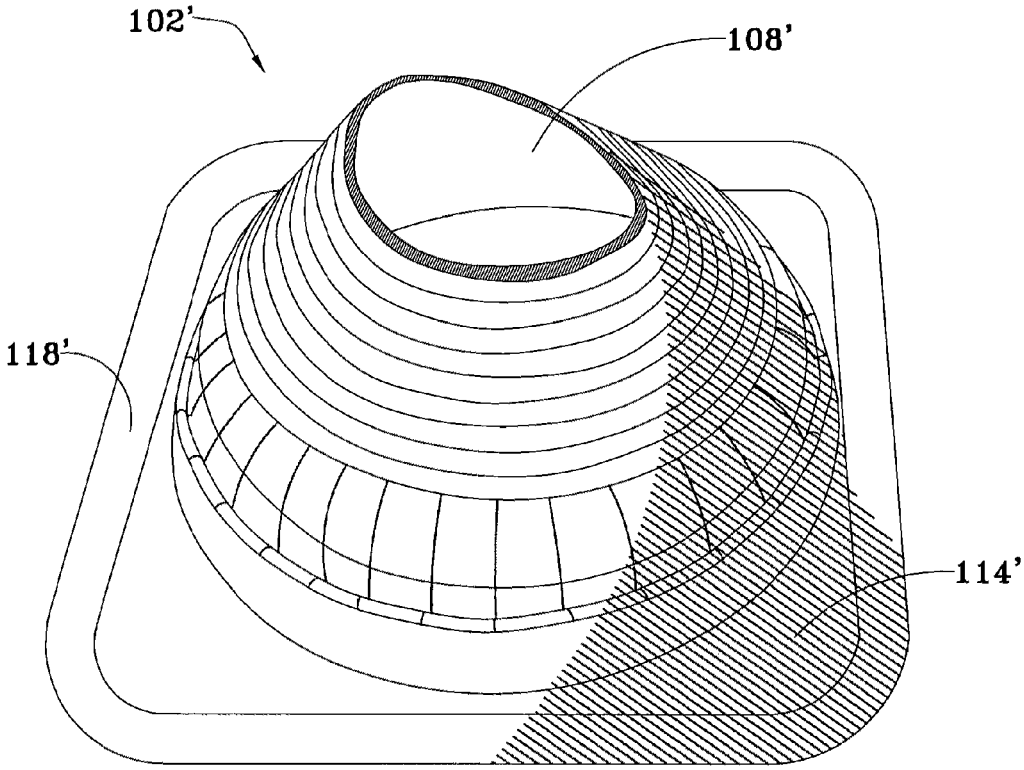
FIG. 8 is a top, perspective view of an alternative flashing for incorporation into my assembly.
Figure 9:
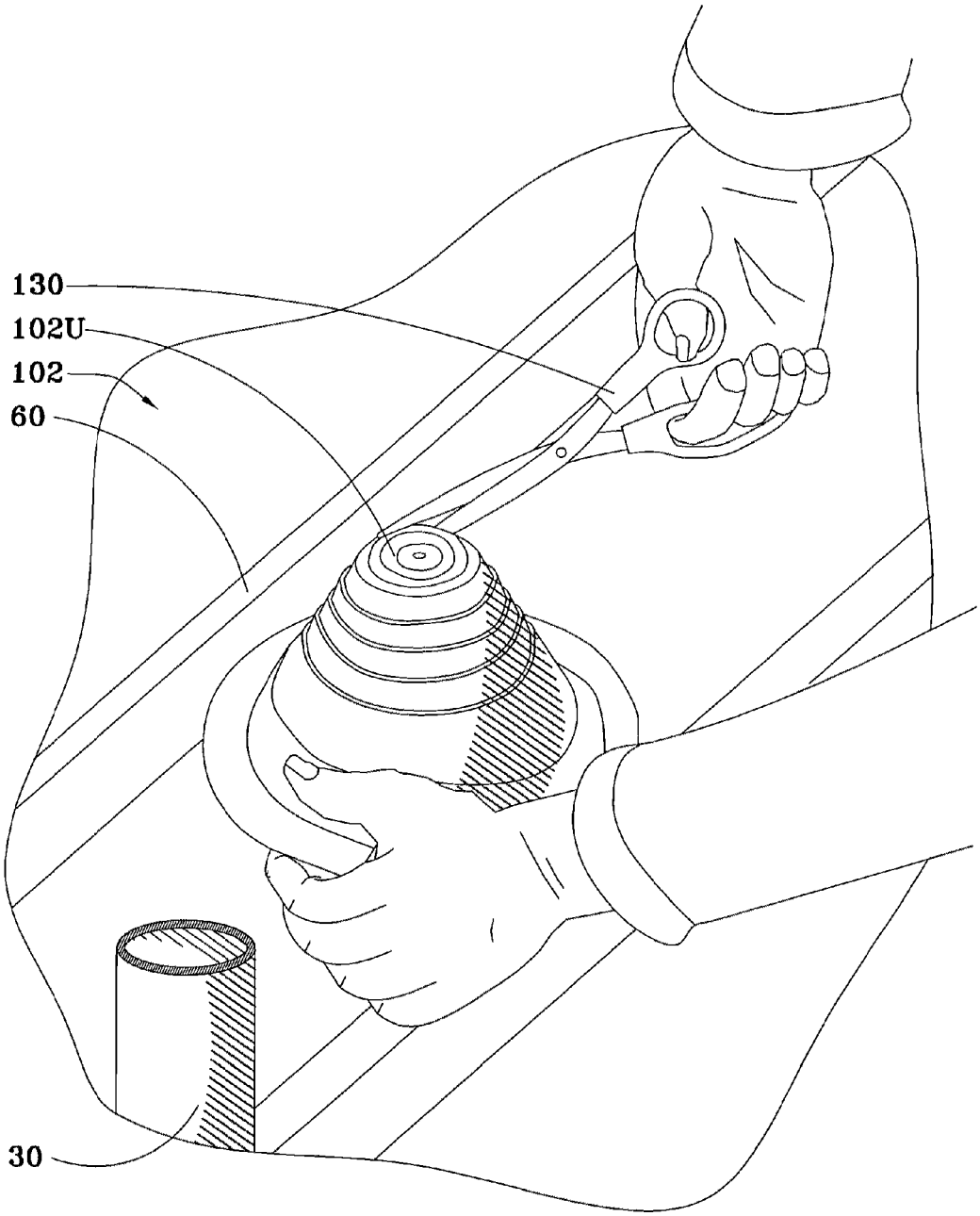
FIG. 9 shows the installation procedure, step 1.
Figure 10:
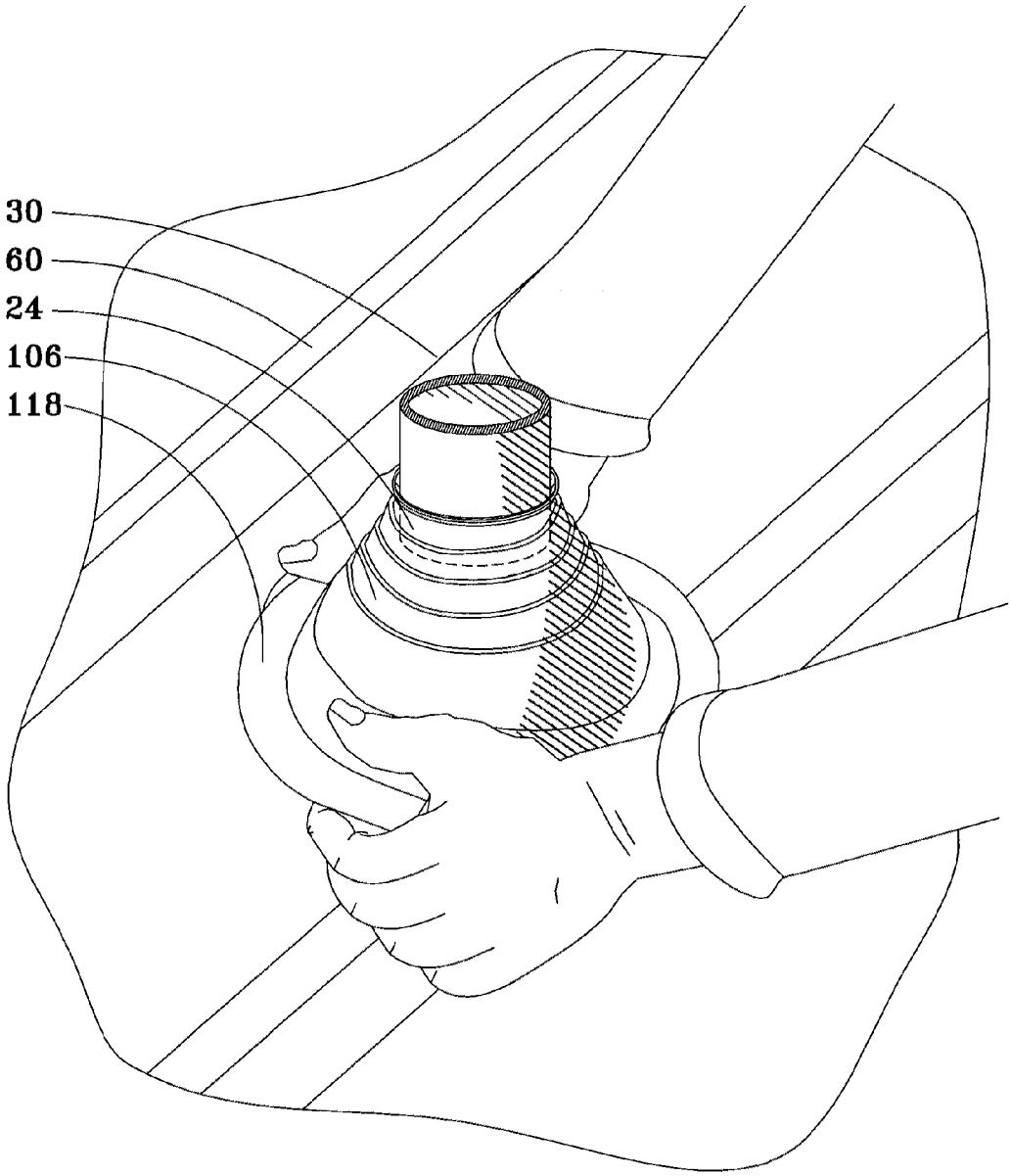
FIG. 10 shows the installation procedure, step 2.
Figure 11:
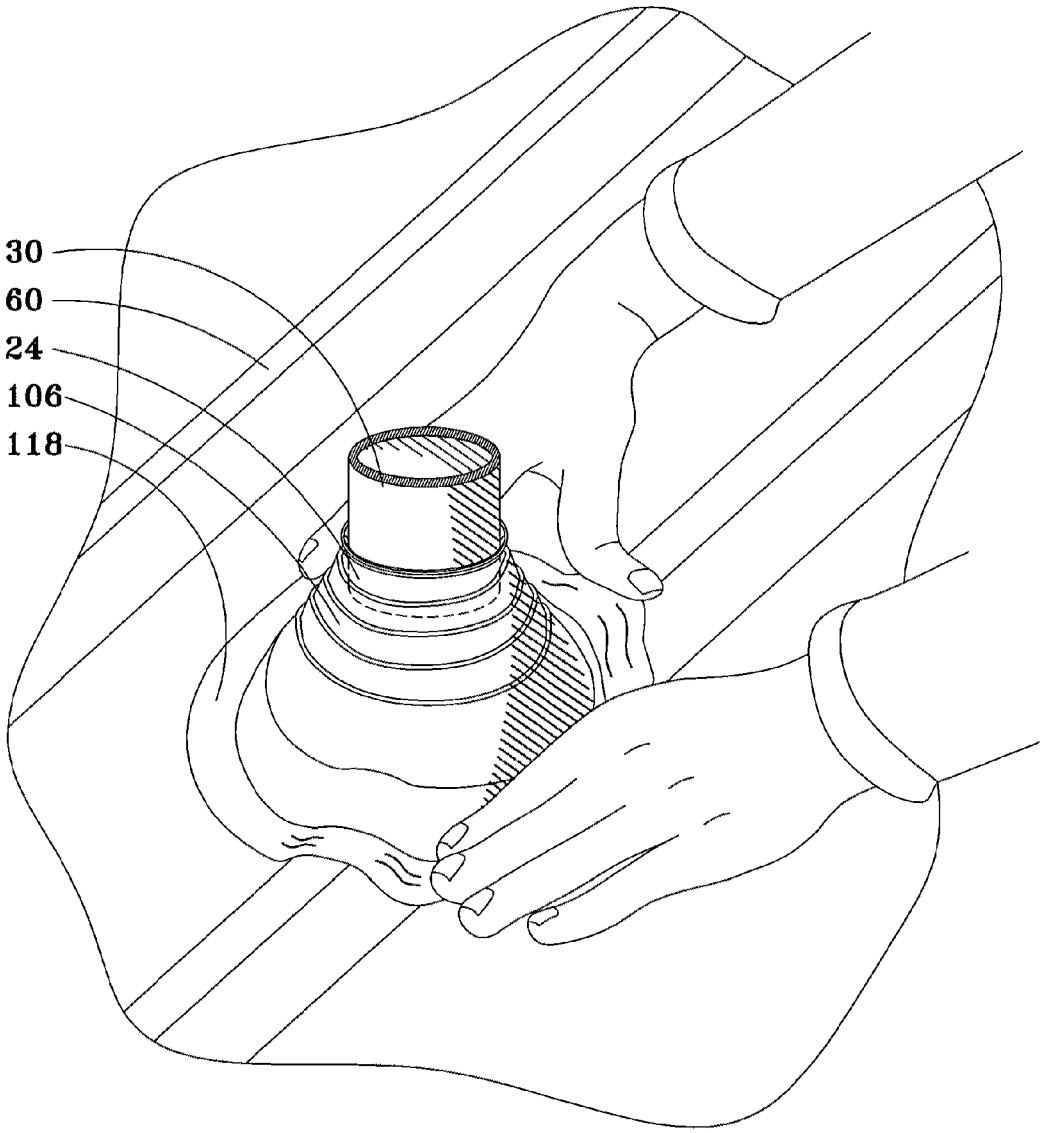
FIG. 11 shows the installation procedure, step 3.
Figure 12:
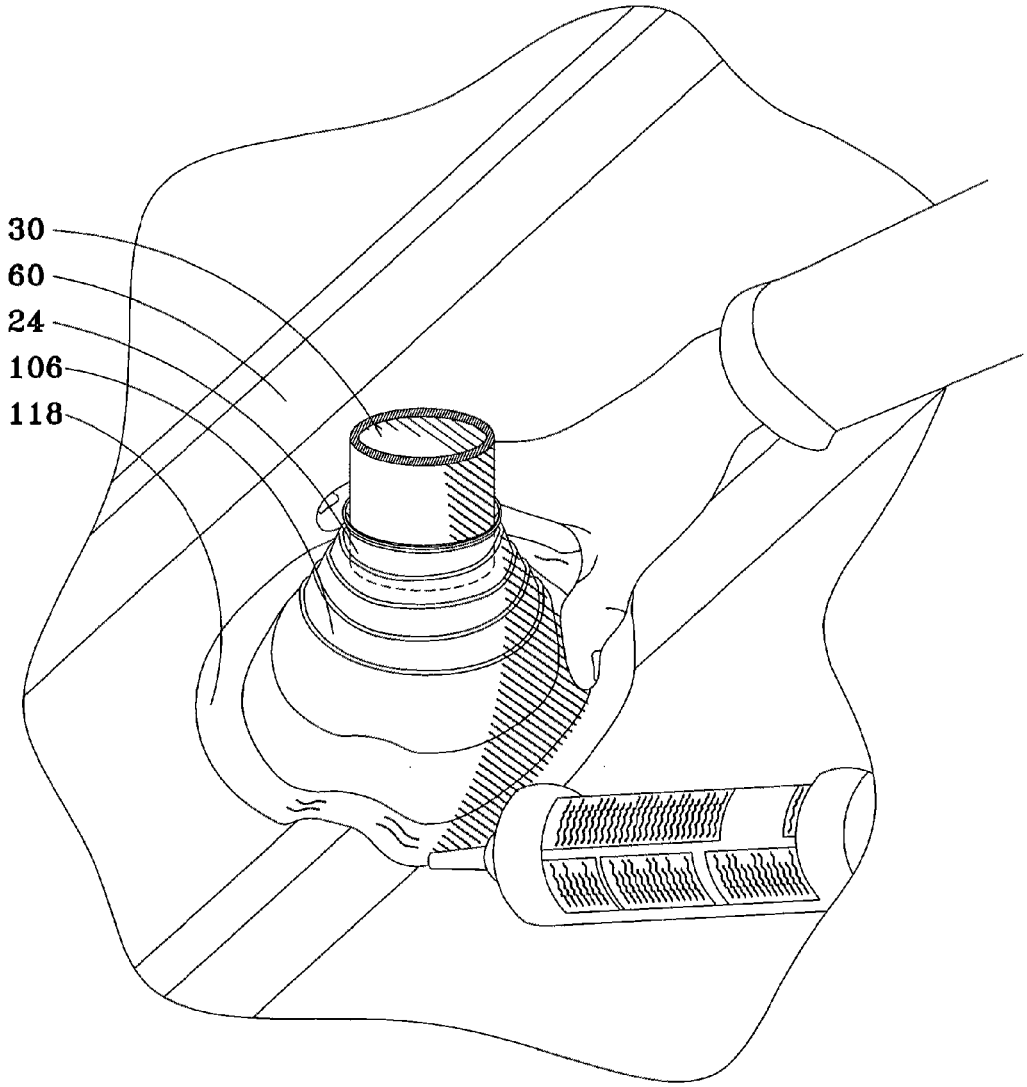
FIG. 12 shows the installation procedure, step 4
Figure 13:
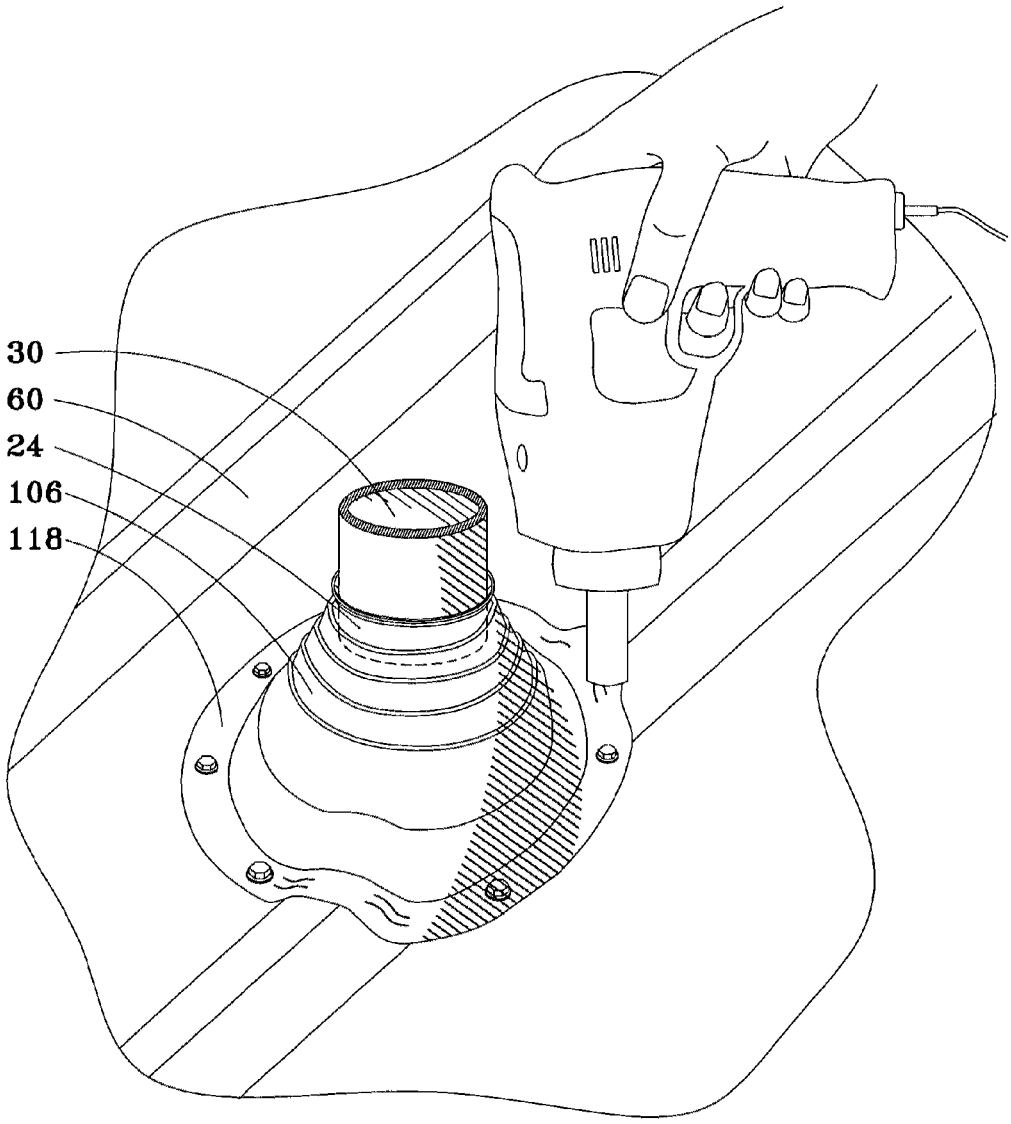
FIG. 13 shows the installation procedure, step 5.
Figure 14:
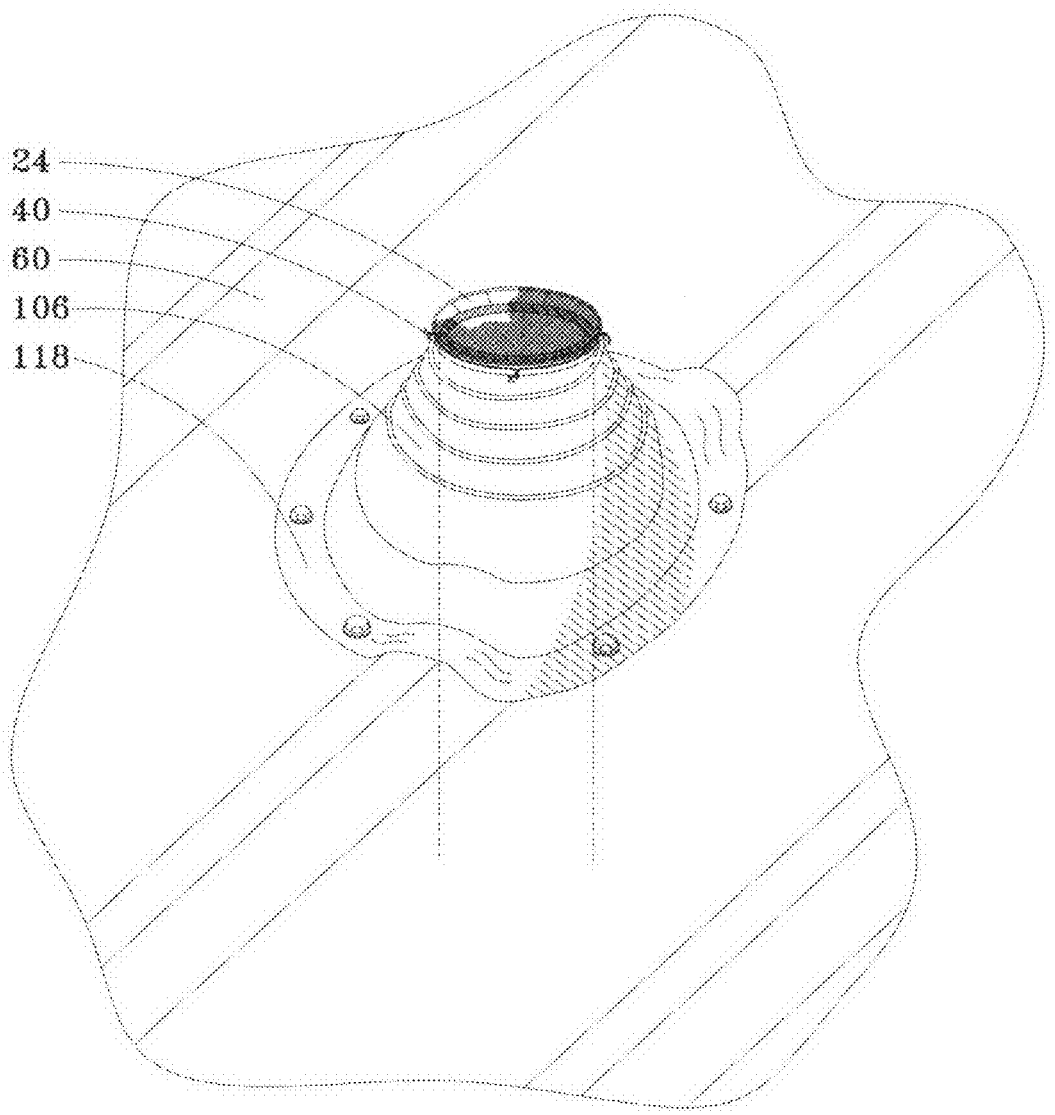
FIG. 14 shows the installation procedure, step 6.
Figure 15:
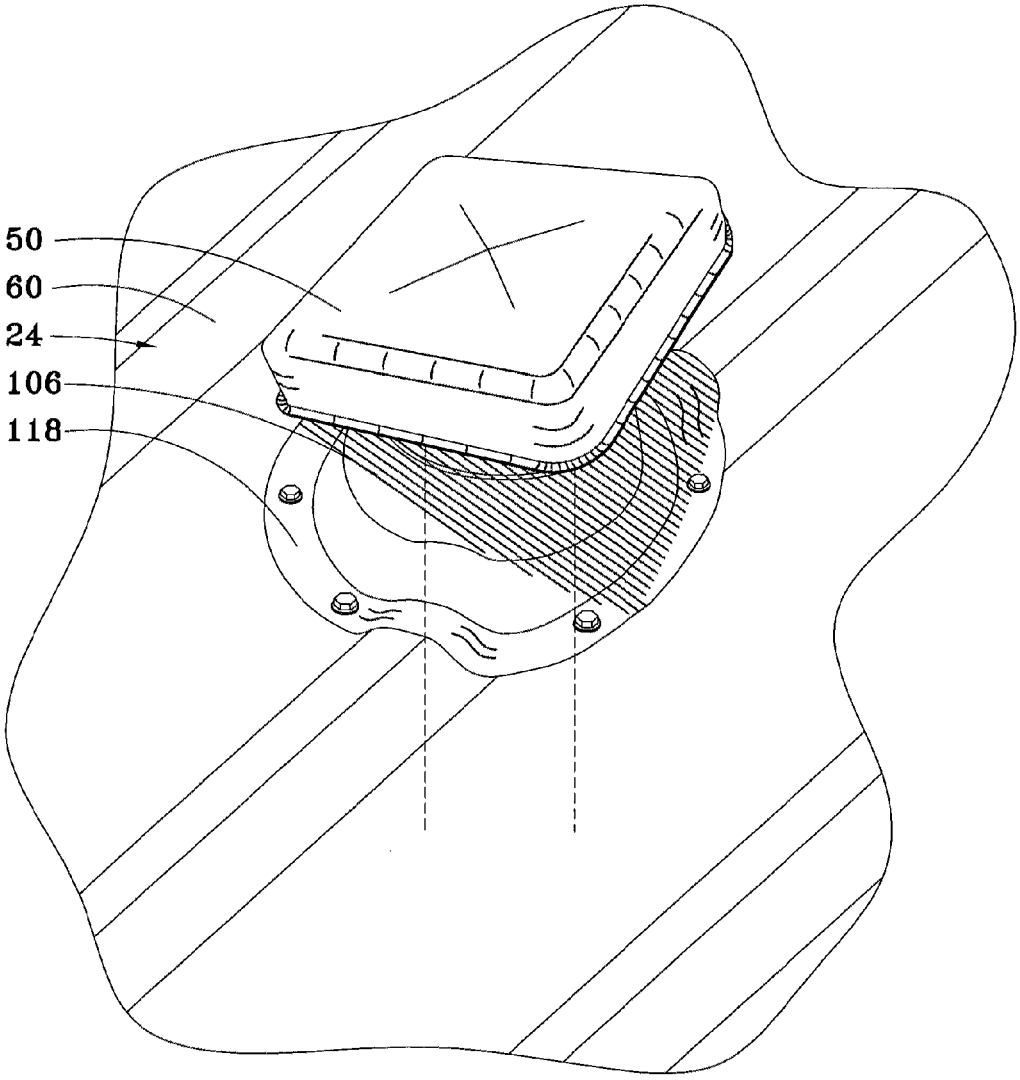
FIG. 15 shows the installation procedure, step 7.

In an alternate embodiment, I substitute for the above-described flashing portion 102 a second, alternative flashing portion 102', as depicted in FIG. 8, which is substantially identical to the flashing portion 102 depicted in FIG. 6 except that the flange 114' thereof has a rectilinear periphery instead of annular shape and the mating, overlying ring seal 118' is also rectilinear. This alternative embodiment 102' of my assembly is otherwise identical to that described above.

In use, my assembly 100 is placed over a corrugated, metal roof opening 12 through which extends a through-the-roof-vent pipe 30, the upper end of the pipe resting against or near the screen 28 and with the flange portion 118 or 118' resting on the corrugated metal roof 60 that surrounds said opening. The installation procedure is depicted in FIGS. 9-15. In the first step (FIG. 9), with the vent hood portion 104 detached from the flashing portion 102, an upper end portion 102U of the flashing 102 is cut away with scissors 130 to leave an upper opening therein that is approximately 20% smaller than the diameter of the collar 24. In the second step (FIG. 10), the collar 24 is inserted into, and attached by screws 54, to the central opening 108 of the sleeve 106 at an upper end portion 102U of the flashing 102. The flashing 102 and attached collar 24 are then slid down around the pipe 30, using water to lubricate if necessary. In the third step (FIG. 11), the ring seal 118 and underlying flange 114 are bent to conform to fit the curved surface of the roof 60. In the fourth step (FIG. 12), the flashing 102 is sealed by applying urethane/silicone sealant between the flange 114 and the surface of the roof 60. In the fifth step (FIG. 13), the seal is completed by fastening the ring seal 118 to the roof with weather-resistant fasteners. In the sixth step (FIG. 14), the mesh screen 28 is placed over the collar 24, its periphery is tamped down around the annular flange 26 at an upper end portion 102U of the sleeve 102; then the yoke 40 is mounted around the screen 28 and collar 24 by tightening adjustment screw 42. In the eighth step (FIG. 15), the cover 50 is attached to the yoke 40 by screws 54.

Although the above description and accompanying drawings relate to specific preferred embodiments of the present invention as presently contemplated by the inventor, it will be understood that various changes, modifications and adaptations may be made without departing from the spirit of the invention. For instance, instead of the described yoke 40, my assembly 100 may include a variety of means for attaching an upper end portion of the flashing 102, 102' to the vent hood 104, such as by metal or plastic brackets that join the vent hood 104 and flashing 102 together such that the cover member 50 and the screen 28 are in fixed, vertically spaced-apart relation. Any suitable fasteners may be substituted for screws 54 and screws 122 as well. It is intended that the invention not be limited to the particular terms used in the following claims and/or to the particular embodiments disclosed as the best mode contemplated for carrying out this invention, but that the invention will include any and all embodiments and equivalents falling within the scope of the appended claims.

I claim:

1. A vent hood and flashing assembly for use on an upper surface of a metal roof having an elongate projection extending upward therefrom, said assembly comprising:

a flashing that includes a resilient, flexible, water-repellant sleeve that is sized to fit over, and surround, the projection, said flashing having an upper end portion and a lower end portion, and said sleeve comprising an elastomeric material chosen from the group consisting of (a) rubber; (b) neoprene; and (c) polyurethane;

a flange that extends outward from, and is attached to, said lower end portion of the flashing, said flange having an upper surface and a lower surface, and said lower surface having a plurality of grooves for sealingly engaging said metal roof; and a flexible, ring seal that overlies the upper surface of the flange; and a vent hood that includes a cover member;

a skirt that depends from the cover member;

means for attaching the upper end portion of the flashing to the vent hood below the cover member, said means including a metal or plastic bracket disposed within, and attached to, the skirt, which bracket is shaped and dimensioned to receive in surrounding engagement the upper end portion of the flashing; and a collar that is shaped and dimensioned to be received by the upper end portion of the sleeve in surrounding engagement whenever the upper end portion of the sleeve is engaged by the bracket; and a plurality of spaced-apart fasteners inserted through the collar and through the upper end portion of the flashing; and a mesh screen that overlies the upper end portion of the flashing, said screen being dimensioned to exclude rodents and other pests from entering the flashing.

2. The assembly of claim 1, wherein the cover member of the hood is flat and rectangular in top plan view, and the skirt comprises four side walls that depend from the respective four side edges of the cover member.

3. The assembly of claim 1, wherein the cover member of the hood is flat and circular in top plan view, and the skirt comprises a cylindrical wall.

4. The assembly of claim 1, wherein the sleeve is bell-shaped and the upper end portion and the lower end portion of the sleeve are circular in horizontal cross-section;

the flange and the ring seal each have annular shape; and the metal or plastic bracket is cylindrical and aligned on a common axis with the upper and lower end portions of the sleeve, and with the collar, flange and ring seal.

5. A vent hood and flashing assembly for use on an upper surface of a metal roof having an elongate projection extending upward therefrom, said assembly comprising:

a flashing that includes a resilient, flexible, water-repellant sleeve that is sized to fit over, and surround, the projection, said flashing having an upper end portion and a lower end portion and said sleeve comprising an elastomeric material chosen from the group consisting of (a) rubber; (b) neoprene; and (c) polyurethane;

a flange that extends outward from, and is attached to, said lower end portion of the flashing, said flange having an upper surface and a lower surface; and a flexible, ring seal that overlies the upper surface of the flange; and a vent hood that includes a cover member;

a skirt that depends from the cover member;

means for attaching the upper end portion of the flashing to the vent hood below the cover member, said means including a yoke disposed within, and attached to, the skirt, which yoke is shaped and dimensioned to receive the upper end portion of the flashing in surrounding engagement;

a collar that is shaped and dimensioned to be received by the upper end portion of the sleeve in surrounding engagement whenever the upper end portion of the sleeve is engaged by the yoke; and a plurality of spaced-apart fasteners inserted through the collar and through the upper end portion of the flashing; and a mesh screen that overlies the upper end portion of the flashing, said screen dimensioned to exclude rodents and other pests from entering the flashing.

6. The assembly of claim 5, wherein the ring seal is fabricated from aluminum.

7. The assembly of claim 6, wherein the sleeve is bell-shaped such that the lower end portion thereof has diameter greater than the diameter of the upper end portion thereof, the collar is cylindrical, the flange and yoke are annular, and the sleeve, ring seal, flange, collar, and yoke are all circumposed about and aligned along a common axis.

8. The assembly of claim 7, wherein the yoke comprises four metal strips joined end-to-end to form a circular ring;

each metal strip is uniformly bent through one-quarter sector of a circle;

each metal strip includes a first end bent radially outward, which forms a mounting tab, said tab having a free end portion that is bent circumferentially and apertured, and an opposite, second end bent radially outward; and said second ends are joined to said first ends.

9. The assembly of claim 8, wherein at least one first end and one second end are each apertured and are joined by a threaded fastener, whereby the tightness of the fit of the yoke around the upper end portion of the sleeve may be adjusted by rotation of said threaded fastener.

10. The assembly of claim 9, wherein the cover member of the hood is flat and rectangular in top plan view, and the skirt comprises four side walls that depend from the respective four side edges of the cover member.

11. The assembly of claim 10, wherein the lower surface of the flange has a plurality of concentric grooves for sealingly engaging said metal roof.

* * * * *